US006345688B1

(12) United States Patent
Veen et al.

(10) Patent No.: US 6,345,688 B1
(45) Date of Patent: Feb. 12, 2002

(54) METHOD AND APPARATUS FOR ABSORBING SOUND

(75) Inventors: Gerald R. Veen, Hudsonville; Marvin R. Mealman, Zeeland, both of MI (US)

(73) Assignee: Johnson Controls Technology Company, Plymouth, MI (US)

( * ) Notice: Subject to any disclaimer, the term of this patent is extended or adjusted under 35 U.S.C. 154(b) by 0 days.

(21) Appl. No.: 09/448,383

(22) Filed: Nov. 23, 1999

(51) Int. Cl.[7] ..... E04B 1/82
(52) U.S. Cl. ..... 181/290; 181/294
(58) Field of Search ..... 181/286, 290, 181/291, 292, 293, 294, 295, 296; 156/222, 280, 307.3, 244.19

(56) References Cited

U.S. PATENT DOCUMENTS 3,214,565 A * 10/1965 Hager, Jr. et al. ..... 181/290
4,838,380 A * 6/1989 Lassiter ..... 181/286
4,851,283 A 7/1989 Holtrop et al.
5,068,001 A 11/1991 Haussling
5,503,903 A 4/1996 Bainbridge et al.
5,536,556 A 7/1996 Juriga
5,632,844 A * 5/1997 Pate ..... 181/294
5,866,235 A 2/1999 Frederick et al.
5,874,136 A 2/1999 Michna et al.
5,892,187 A 4/1999 Patrick

* cited by examiner

*Primary Examiner*—Khanh Dang
(74) *Attorney, Agent, or Firm*—Foley & Lardner

(57) ABSTRACT

A tunable sound absorber including a fibrous batt having a plurality of fibers and a film coupled to the surface of the fibrous batt, where the fibers penetrate the film to create perforations, and where the perforations transfer sound energy to the fibrous batt and the sound energy is absorbed by the fibrous batt.

32 Claims, 3 Drawing Sheets

METHOD AND APPARATUS FOR ABSORBING SOUND

BACKGROUND OF THE INVENTION

The present invention relates to sound absorption material. More specifically, the present invention relates to a fibrous acoustical absorber used in automotive trim panels that may be tuned during its fabrication for maximum sound absorption over a wide frequency range or in a specific frequency range.

A sound absorbing material must have the proper combination of hardness, density, and air flow to absorb and attenuate sound in a desired manner. Sound energy is comprised of high and low waves of air pressure that propagate through the air and can be absorbed and attenuated through many actions or mechanisms. Many materials absorb and attenuate sound through viscous losses (i.e., the movement or shearing of air in a material) or by sound induced mechanical/kinetic energy losses in the fibers of a material that result in sound energy being converted to heat. Generally, a foam-like material will attenuate sound though viscous losses and a fibrous material will attenuate sound through the kinetic energy dissipation created by the movement of its fibers. Other materials may utilize a combination of both viscous and mechanical losses.

The porosity and stiffness of a material will affect its air flow characteristics and thus its sound absorption and attenuation characteristics. For example, a relatively stiff and nonporous material having high acoustical resistance, such as brick, will merely reflect sound, as the sound energy will not easily propagate through the brick. Conversely, a window screen with low acoustical resistance will allow large amounts of air and thus sound to quickly propagate through it, attenuating only a small amount of the sound energy.

There are many applications, including the automotive field, where sound absorption and attenuation is important to the consumer. The interior surface of a vehicle is commonly covered or lined with panels of sound absorbent material that present an aesthetically appealing appearance and also absorb or attenuate exterior sound. Molded fiber glass panels and foam liners are examples of such materials used in vehicles that are able to attenuate sound over a wide range of frequencies. Conventionally, such panels are either single or multi-layered structures of fiberglass or foam material having an outside covering layer visible in the cabin, typically of a cloth or soft material, and a backing layer of a relatively stiff material that is adhered to the interior of the vehicle cabin.

Automotive headliners have evolved from simple fabric or fiberglass covered foam to improved designs specifically adapted to provide sound absorption and attenuation in a vehicle. Yet, there remains a need for improved sound barriers that attenuate sound over a broad range of frequencies or, alternatively, may be tuned for maximum sound attenuation in a specific frequency. The present invention utilizes a fibrous pad as the sound attenuation component of a trim panel that may be tuned to attenuate sound in a specific frequency range.

SUMMARY OF THE INVENTION

In accordance with the present invention, a tunable sound absorbing fibrous pad is formed by applying a film to a fibrous sheet or batt of material using heat and pressure. The sound absorbing fibrous pad is preferably formned in a continuous process such as a webline, where linespeed, heat, and pressure may be varied. In operation, the heat and pressure applied to the fibers cause the fibers of the fibrous batt to penetrate the film and create perforations within the film and the linespeed of the process will determine the exposure time of the film to the heat and pressure. Heat from the process can "blow open" the perforations caused by the geometric surface of the fibrous pad and create larger holes corresponding to higher process temperatures. These variables in combination will determine the size and number of perforations in the film. The size and number of perforations control the air flow resistance of the film and thus, the sound absorbing and attenuation properties of the sound absorbing fibrous pad. Accordingly, the sound absorbing and attenuation characteristics of the sound absorbing fibrous pad can be modified during the fabrication of the sound absorbing fibrous pad by varying the process variables.

An object of the present invention is to create a sound absorbing pad that may be tuned to absorb sound in a desired frequency range. As discussed previously, the processing of the pad may be manipulated such that the pad may be tuned to absorb sound at predetermined frequencies. Specifically, the material of the present invention may be tailored to attenuate problematic sound frequencies produced in a vehicle cabin.

Another object of the present invention is to create a sound absorbing pad that has been optimized to absorb and attenuate as much sound over as wide a range of frequencies as possible for the type of material being used.

A further object of the present invention is to provide an interior trim pad that is made predominantly of synthetic fibers so that the fibrous pad can be recycled or made recyclable.

BRIEF DESCRIPTION OF THE DRAWINGS

The various advantages of the present invention will become apparent to those skilled in the art after reading the following specification and by reference to the drawings, in which.

DETAILED DESCRIPTION OF THE PREFERRED EMBODIMENT

The following description of the present embodiment is merely exemplary in nature and is in no way intended to limit the invention, its application, or its uses. Moreover, while the preferred embodiment describes a sound absorbing fibrous pad designed to operate with a vehicle, the following description is intended to adequately teach one skilled in the art to make and use the sound absorbing fibrous pad for other applications.

Figure 1:
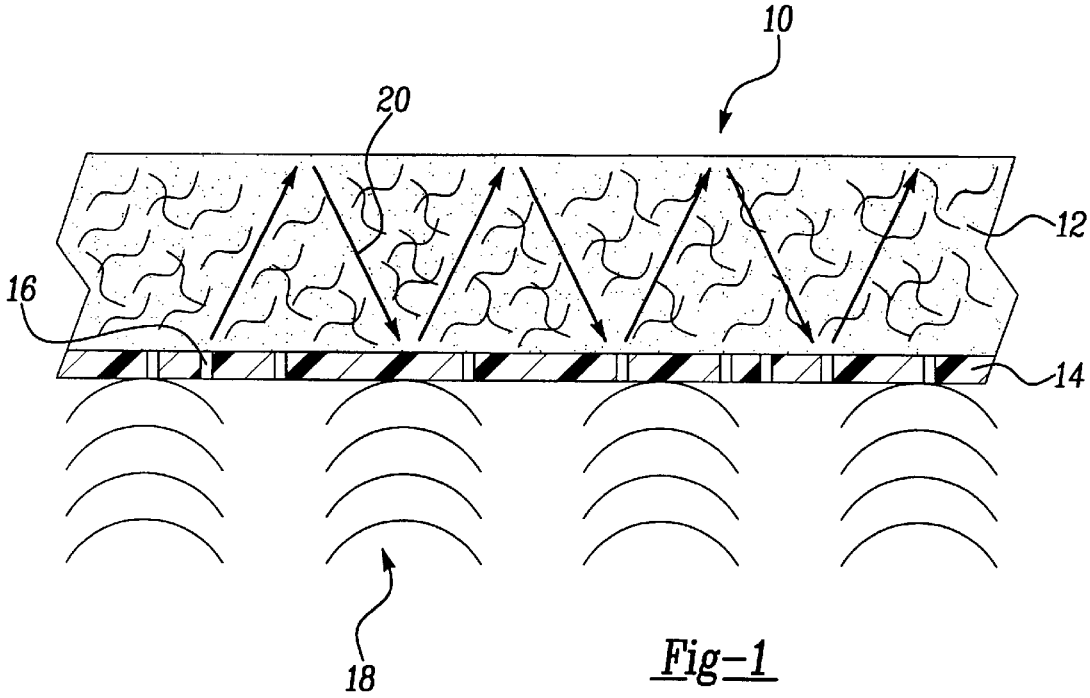
FIG. 1 is a diagrammatic schematic cross-sectional view of the sound absorbing pad made according to the teachings of the preferred embodiment of the present invention.

FIG. 1 is a partial cross section of the sound absorbing fibrous pad 10 of the present invention. The sound absorbing pad 10 includes a fibrous batt 12 and a film 14 coupled to one side of the fibrous batt 12. In alternate embodiments of the present invention, the film 14 may be applied to both sides of the fibrous batt 12. The fibrous batt 12 is preferably comprised of virgin or recycled polymeric fibers such as polyethylene terepthalate (PET), polyester, polypropylene, and nylon, but may also be comprised of natural fibers such as cotton. The fibers of the fibrous batt preferably have a diameter between 10–100 microns with the average effective diameter of the fibers being approximately 22 microns and the fibrous batt 12 is preferably 5–30 mm thick. In one embodiment of the sound absorbing pad 10, the fibrous batt 12 includes binding polymeric fibers with a relatively low melting point when compared to the remaining fibers in the fibrous batt 12. These binding fibers will melt at a lower temperature than the remaining fibers in the fibrous batt 12, coupling the fibers of the fibrous batt 12 and ensuring that the fibers of the fibrous batt 12 are firmly bound. The film 14 is preferably comprised of polyethylene, polyester, or PET but may be any type of film that is thermoformable or thermosettable. The use of polymeric and thermoformable materials for the fibrous batt 12 and the film 14 will aid in the recycling of the sound absorbing pad 10.

The film 14 is overlaid onto the fibrous batt 12 preferably in a continuous process such as a webline which will be more fully described below. Heat and pressure are applied to the film 14 during processing, causing the fibers of the fibrous batt 12 to penetrate the film 14 and form microruptures or perforations 16. The size and number of these perforations 16 determine the sound absorbing and attenuating characteristics of the resultant sound absorbing pad 10. Referring to FIG. 1, the film side of the sound absorbing pad 10 is positioned to face incident sound waves 18. The sound waves 18 contact the film 14 and are conducted through the film 14 via the perforations 16. The energy of the sound waves 18 is then transmitted to the fibers of the fibrous batt 12. The fibers will absorb the sound energy as kinetic energy and oscillate until the energy is dissipated as heat. The sound energy is further dissipated through viscous losses (air shearing and movement) that also result in heat. Furthermore, the sound upon entering the fibrous batt 12 is trapped within the fibrous batt 12 and continuously reflects off the film 14, as shown by arrows 20. This reflection multiplies the damping and attenuation effects of the fibers in the fibrous batt 12, providing a superior sound absorbing pad.

Figure 2:
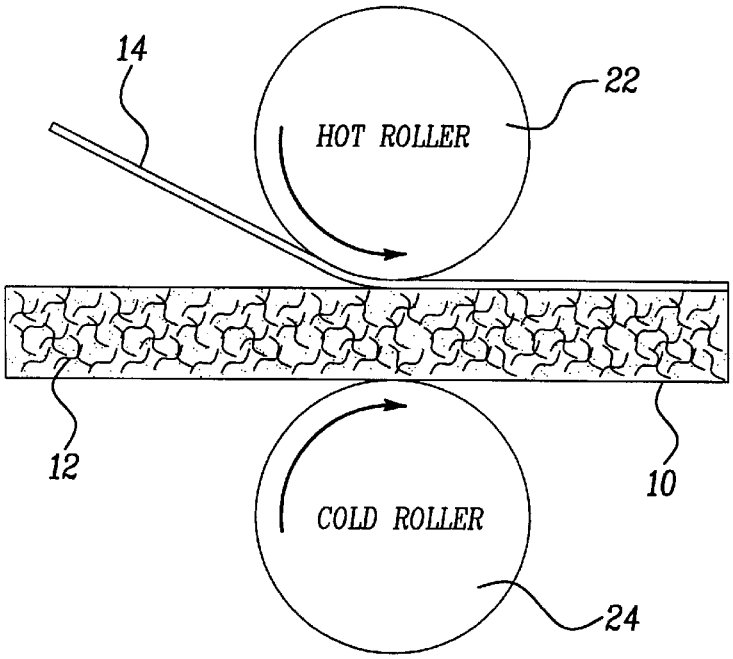
FIG. 2 is a diagram of the process used to fabricate the sound absorbing pad shown in FIG. 1 made according to the teachings of the preferred embodiment of the present invention.

The process for forming the sound absorbing pad 10 is a continuous process and can be seen in FIG. 2. The fibrous batt 12 under tension and the film 14 under tension are fed between a hot roller 22 and a cold roller 24 that laminate the fibrous batt 12 and film 14. The fibrous batt 12 and film 14 are preferably unwound with torque or tension controlled unwinds with or without tension feedback. Electric motors, magnetic clutches, and mechanically weighted unwinds may be used to unwind the fibrous batt 12 and film 14.

The hot roller 22 and cold roller 24 apply pressure or pinch the film 14 and fibrous batt 12 together to create the lamination. The hot roller 22 and cold roller 24 are preferably forced together by a pressure device such as a hydraulic or pneumatic piston but any other type of pressure generating device is within the scope of the present invention. The hot roller 22 is heated to a predetermined temperature to soften the film 14 so that the fibers of the fibrous batt 12 can penetrate the film 14 to create the perforations 16. The cold roller 24 cools the fibrous batt 12 to prevent it from transforming into a block of molten plastic. The temperatures of the hot roller 22 and the cold roller 24 are balanced to create a temperature gradient such that only the film at the interface of the fibrous batt 12 enters the molten stage, allowing the fibers of the fibrous batt 12 to penetrate the film 14 and create the perforations 16. The resulting sound absorbing pad 10 is porous and has excellent sound absorptive and attenuation properties along with a desirable resilient feel.

As discussed above, a continuous process is used to form the sound absorbing pad 10. Thus, the hot roller 22 and cold roller 24 are turning at a certain line speed or surface speed. The line speed determines the exposure time of the film 14 and fibrous batt 12 to the applied heat and pressure. Accordingly, the line speed in combination with the heat and pressure applied to the film 14 will determine the size and number of the perforations 16 in the film 14.

The resultant size and number of perforations 16 formed during processing change the sound absorbing pad's 10 air flow resistance and thus its sound absorption and attenuation characteristics. The process may be tuned to create the optimum air flow resistance in order to maximize the overall acoustic absorption of the sound absorbing pad 10 or tuned for a maximum absorption in a specific sound frequency range.

Figure 3:
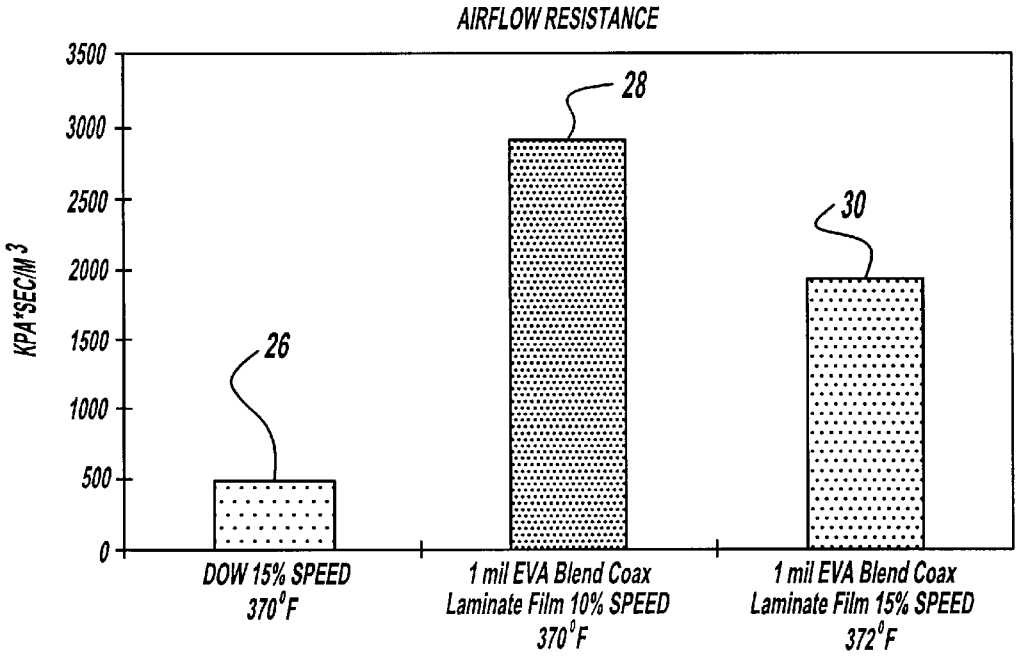
FIG. 3 is a bar chart illustrating the air flow resistance of different materials manufactured with different process variables using the method according to the preferred embodiment of the present invention.

FIG. 3 is a bar chart showing the air flow resistance of the sound absorbing pad 10 for different film 14 materials laminated to a polymeric post industrial or recycled fibrous batt 12 at different line speeds. Maximum or 100% linespeed is defined as 80 feet per minute. The first bar 26 is a measurement of the air flow resistance of the sound absorbing pad 10 with Dow 933 film run at 15% speed at 370° F. (sample 14 seen in Table 1). The second bar 28 is a measurement of the air flow resistance of the sound absorbing pad 10 with 1 mil EVA Blend Coax Laminate film run at 10% speed at 370° F. (sample 12 seen in Table 1). The third bar 30 is a measurement of the air flow resistance of the sound absorbing pad 10 with 1 mil EVA Blend Coax Laminate film run at 15% speed at 372° F. (sample 13 seen in Table 1). The pinch pressure between the hot roller 22 and cold roller 24 was kept constant for all three runs. As can be seen from the bar chart, the air flow resistance of the sound absorbing pad 10 will vary with linespeed.

Figure 4:
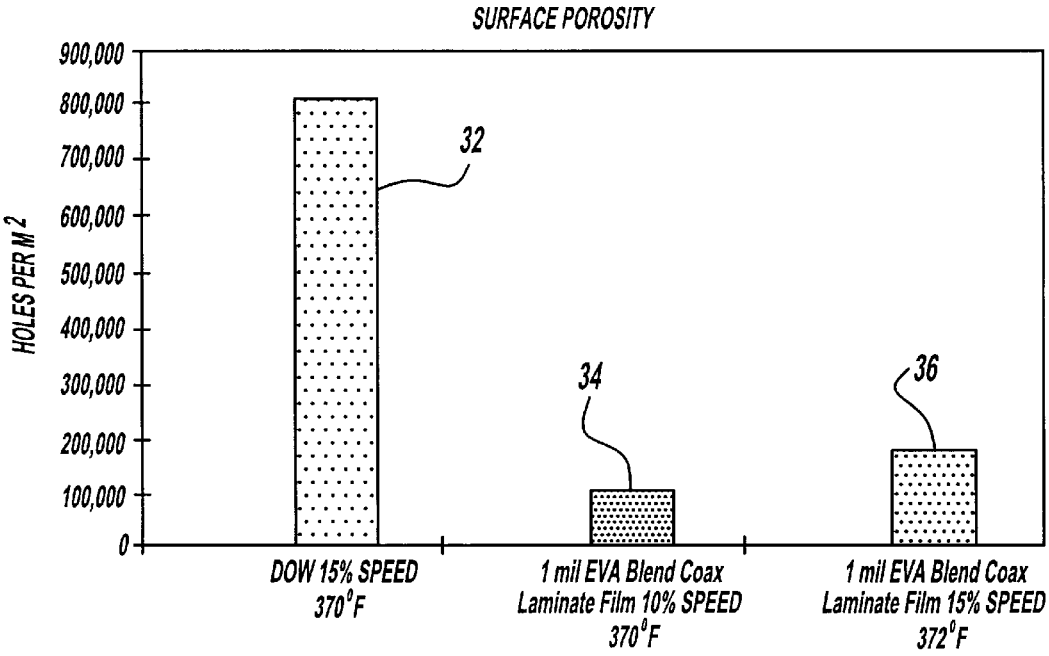
FIG. 4 is a bar chart illustrating the surface porosity of different materials manufactured with different process variables using the method according to the preferred embodiment of the present invention.

Referring to the bar chart of FIG. 4, surface porosities corresponding to the air flow resistance values of FIG. 3 are detailed with reference to the sound absorbing pad 10 having different films 14 laminated to the fibrous batt 12. The first bar 32 is a measurement of the surface porosity of Dow 933 run at 15% speed at 370° F. (sample 14) and corresponds to bar 26 of FIG. 3. The second bar 34 is a measurement of the surface porosity of 1 mil EVA Blend Coax Laminate film run at 10% speed at 370° F. (sample 12) and corresponds to bar 28 of FIG. 3. The third bar 36 is a measurement of the surface porosity of 1 mil EVA Blend Coax Laminate film run at 15% speed at 372° F. (sample 13) and corresponds to bar 30 of FIG. 3. While specific test results have been detailed in this paragraph, the linespeed, temperature and pressure may be varied to attain a wide range of air flow resistances and porosities. The above examples were included to illustrate that the variation in process variables will result in a variation of surface porosity and air flow resistance. Accordingly, the acoustic resistance of the film 14 and thus, the sound absorption of the sound absorbing pad 10, will also vary.

Generally, a sound absorbing pad with a film with lower hole density (1–400,000 holes per $m^2$) will have better sound attenuation and absorbing characteristics in the low frequency ranges (200–1200 Hz) and a sound absorbing pad with film with a higher hole density (>400,000 holes per $m^2$) will have better sound attenuation characteristics in the higher frequency ranges (>1200 Hz). The optimum hole density for sound absorption over a wide frequency range is usually somewhere in the middle hole density ranges i.e. 400,000 holes per $m^2$.

Figure 5:
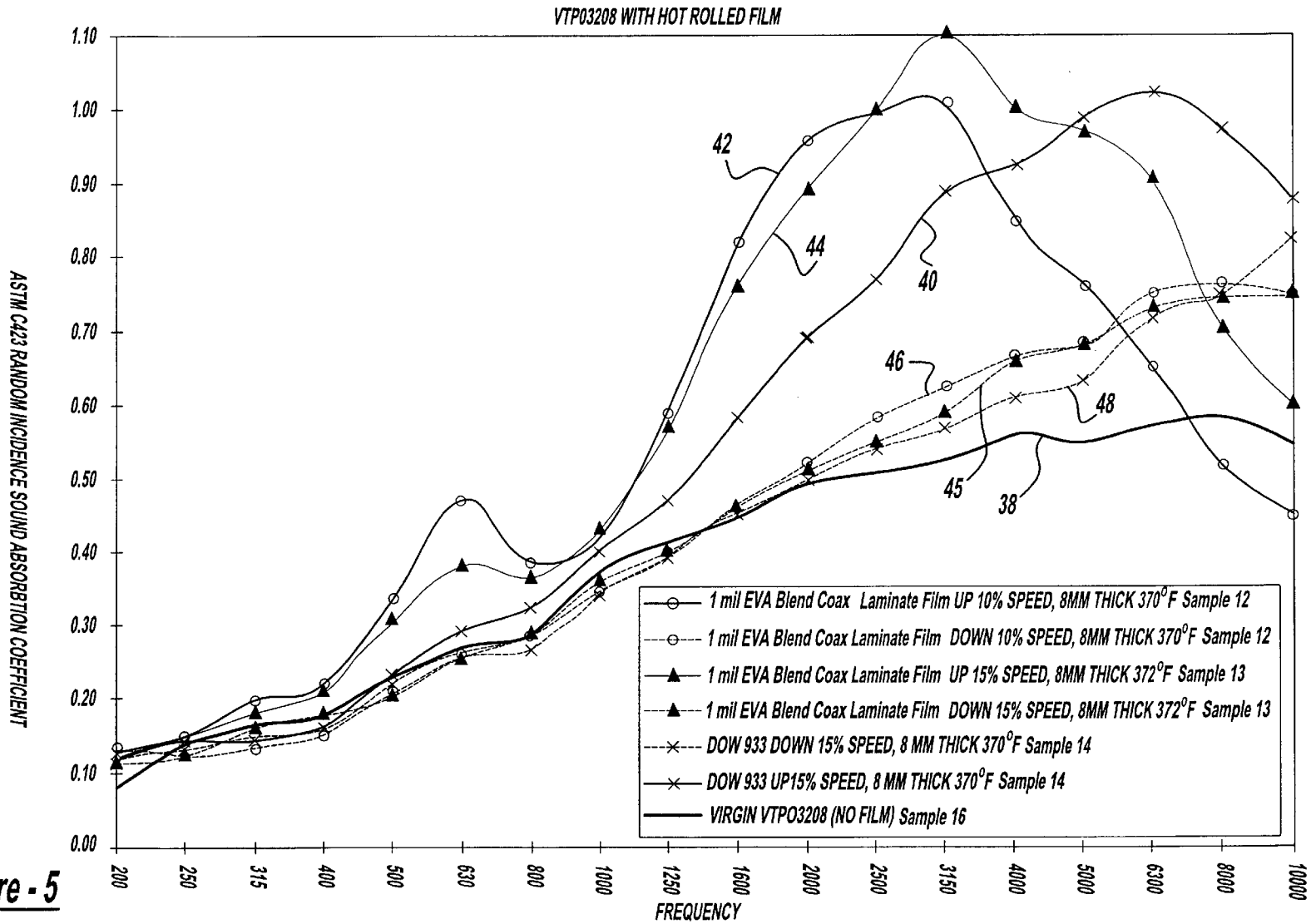
FIG. 5 is a graph illustrating the sound attenuation performance enhancements of the present invention according to the preferred embodiment.

FIG. 5 is a graph of the sound absorption characteristics vs. sound frequency for a sound absorbing pad having a virgin batt with no film and a sound absorbing pad and films that have been perforated by the fibrous batt during processing. The term "up" means that the film side of the material is tested towards the incident sound waves and the term "down" means that the non-film side is tested towards the incident sound waves. As can be seen from the graphs the sound absorbing characteristics of the sound absorbing pad 10 have been greatly increased by the method of the present invention. Line 38 represents a sound absorbing pad having a virgin fibrous batt of VTP03208. Lines 40, 42, 44, 45, 46, and 48 represent the sound absorbing characteristics of Dow 933 and 1 mil EVA Blend Coax Laminate films laminated by the method of the present invention to a polymeric fibrous batt 12 to form perforations 16 in the films. Lines 40 and 48 correspond to bar 26 of FIG. 3, bar 32 of FIG. 4, and sample 14 of Table 1. Lines 42 and 46 correspond to bar 28 of FIG. 3, bar 34 of FIG. 4, and sample 12 of Table 1. Lines 44 and 45 correspond to bar 30 of FIG. 3, bar 36 of FIG. 4, and sample 13 of Table 1. As can be seen from the graph and the following table, the films processed by the method of the present invention have higher sound absorption coefficients than the virgin VTP03208 batt.

TABLE 1

Variation of sound absorption characteristics of the fibrous pad 10, having fibrous batt 12 and film 14, in response to a variation in process variables. The term "up" means that the film side of the material is tested towards the incident sound waves and the term "down" means that the non-film side is tested towards the incident sound waves. The speed is defined as a percentage of total speed which is 80 feet per minute. The defined thickness is the thickness of the fibrous batt 12.

| Freq. | Dow 933 down, 10% speed, 18 mm thick 350° F. sample 1 | Dow 933 up, 10% speed, 18 mm thick 350° F. sample 1 | Dow 933 down, 10% speed, 18 mm thick 350° F. sample 2 | Dow 933 up, 10% speed, 18 mm thick 350° F. sample 2 | Dow 933 down,10% speed, 18 mm thick 350° F. sample 3 | Dow 933 up, 10 % speed, 18 mm thick 350° F. sample 3 | Dow 933 down, 10% speed, 18 mm thick 350° F. sample 4 | Dow 933 up, 10% speed, 18 mm thick 350° F. sample 4 | Dow 933 down, 15 % speed, 18 mm thick 350° F. sample 5 | Dow 933 up, 15% speed, 18 mm thick 350° F. sample 5 |
|---|---|---|---|---|---|---|---|---|---|---|
| 200 | 0.16 | 0.18 | 0.15 | 0.12 | 0.14 | 0.09 | 0.11 | 0.09 | 0.15 | 0.13 |
| 250 | 0.18 | 0.18 | 0.18 | 0.19 | 0.16 | 0.19 | 0.16 | 0.19 | 0.14 | 0.20 |
| 315 | 0.19 | 0.21 | 0.18 | 0.22 | 0.19 | 0.21 | 0.19 | 0.23 | 0.23 | 0.25 |
| 400 | 0.17 | 0.19 | 0.17 | 0.22 | 0.20 | 0.22 | 0.20 | 0.22 | 0.23 | 0.23 |
| 500 | 0.23 | 0.27 | 0.22 | 0.26 | 0.24 | 0.28 | 0.22 | 0.29 | 0.27 | 0.27 |
| 630 | 0.27 | 0.33 | 0.27 | 0.36 | 0.27 | 0.35 | 0.29 | 0.35 | 0.29 | 0.31 |
| 800 | 0.28 | 0.39 | 0.29 | 0.43 | 0.28 | 0.43 | 0.29 | 0.43 | 0.32 | 0.34 |
| 1000 | 0.35 | 0.54 | 0.36 | 0.59 | 0.35 | 0.60 | 0.36 | 0.60 | 0.39 | 0.43 |
| 1250 | 0.39 | 0.70 | 0.41 | 0.71 | 0.39 | 0.76 | 0.40 | 0.76 | 0.42 | 0.50 |
| 1600 | 0.43 | 0.80 | 0.44 | 0.84 | 0.43 | 0.86 | 0.45 | 0.90 | 0.47 | 0.59 |
| 2000 | 0.46 | 0.93 | 0.45 | 0.98 | 0.47 | 0.99 | 0.47 | 0.97 | 0.49 | 0.68 |
| 2500 | 0.49 | 1.01 | 0.48 | 1.02 | 0.52 | 1.02 | 0.51 | 1.03 | 0.50 | 0.73 |
| 3150 | 0.51 | 1.01 | 0.52 | 1.02 | 0.54 | 1.01 | 0.56 | 1.01 | 0.53 | 0.79 |
| 4000 | 0.54 | 0.97 | 0.54 | 0.93 | 0.57 | 0.94 | 0.59 | 0.91 | 0.55 | 0.80 |
| 5000 | 0.57 | 0.88 | 0.59 | 0.85 | 0.61 | 0.84 | 0.61 | 0.82 | 0.55 | 0.80 |
| 6300 | 0.61 | 0.76 | 0.64 | 0.74 | 0.66 | 0.73 | 0.68 | 0.73 | 0.62 | 0.77 |
| 8000 | 0.67 | 0.64 | 0.68 | 0.61 | 0.72 | 0.62 | 0.74 | 0.63 | 0.67 | 0.70 |
| 10000 | 0.66 | 0.57 | 0.68 | 0.55 | 0.76 | 0.57 | 0.75 | 0.58 | 0.68 | 0.74 |

| Freq. | Dow 933 down, 15% speed, 18 mm thick 350° F. sample 6 | Dow 933 up 15% speed, 18 mm thick 350° F. sampe 6 | Dow 933 down, 15% speed, 18 mm thick 350° F. sample 7 | Dow 933 up 15% speed, 18 mm thick 350° F. sample 7 | 1 mil EVA* down, 10% speed, 18 mm thick 370° F. sample 8 | 1 mil EVA* 10% speed, 18 mm mm thick 370° F. sample 8 | mil EVA* up 15% speed, 18 mm thick 372° F. sample 9 | 1 mil EVA* down 15% speed, 18 mm thick 372° F. sample 10 | 1 mil EVA* up 15% speed, 18 mm thick 372° F. sample 10 | 1 mil EVA* down 15 18 mm thick 372° F. sample 11 |
|---|---|---|---|---|---|---|---|---|---|---|
| 200 | 0.21 | 0.17 | 0.15 | 0.18 | 0.14 | 0.11 | 0.14 | 0.14 | 0.10 | 0.15 |
| 250 | 0.19 | 0.20 | 0.20 | 0.20 | 0.15 | 0.16 | 0.24 | 0.16 | 0.24 | 0.18 |
| 315 | 0.21 | 0.18 | 0.20 | 0.23 | 0.20 | 0.24 | 0.27 | 0.22 | 0.26 | 0.23 |
| 400 | 0.20 | 0.21 | 0.23 | 0.23 | 0.18 | 0.22 | 0.26 | 0.22 | 0.27 | 0.22 |
| 500 | 0.27 | 0.28 | 0.27 | 0.29 | 0.22 | 0.30 | 0.35 | 0.28 | 0.33 | 0.26 |
| 630 | 0.30 | 0.32 | 0.30 | 0.31 | 0.26 | 0.37 | 0.40 | 0.31 | 0.41 | 0.29 |
| 800 | 0.31 | 0.34 | 0.31 | 0.35 | 0.27 | 0.46 | 0.S0 | 0.33 | 0.S0 | 0.32 |
| 1000 | 0.39 | 0.42 | 0.38 | 0.45 | 0.35 | 0.69 | 0.68 | 0.40 | 0.70 | 0.40 |
| 1250 | 0.41 | 0.49 | 0.41 | 0.S0 | 0.39 | 0.85 | 0.84 | 0.43 | 0.86 | 0.43 |
| 1600 | 0.47 | 0.57 | 0.46 | 0.57 | 0.45 | 0.98 | 0.97 | 0.47 | 0.96 | 0.48 |
| 2000 | 0.49 | 0.63 | 0.48 | 0.65 | 0.48 | 1.03 | 1.02 | 0.53 | 1.01 | 0.51 |
| 2500 | 0.S0 | 0.70 | 0.49 | 0.70 | 0.52 | 0.98 | 1.02 | 0.53 | 1.02 | 0.55 |
| 3150 | 0.52 | 0.77 | 0.51 | 0.78 | 0.56 | 0.84 | 0.95 | 0.56 | 0.97 | 0.56 |
| 4000 | 0.54 | 0.77 | 0.52 | 0.79 | 0.61 | 0.70 | 0.86 | 0.58 | 0.83 | 0.6t |
| 5000 | 0.54 | 0.72 | 0.53 | 0.75 | 0.63 | 0.62 | 0.71 | 0.63 | 0.72 | 0.65 |
| 6300 | 0.57 | 0.70 | 0.58 | 0.69 | 0.71 | 0.54 | 0.60 | 0.70 | 0.61 | 0.71 |
| 8000 | 0.56 | 0.60 | 0.57 | 0.61 | 0.75 | 0.47 | 0.49 | 0.74 | 0.52 | 0.80 |
| 10000 | 0.55 | 0.59 | 0.54 | 0.61 | 0.79 | 0.46 | 0.52 | 0.80 | 0.51 | 0.83 |

TABLE 1-continued

Variation of sound absorption characteristics of the fibrous pad 10, having fibrous batt 12 and film 14, in response to a variation in process variables. The term "up" means that the film side of the material is tested towards the incident sound waves and the term "down" means that the non-film side is tested towards the incident sound waves. The speed is defined as a percentage of total speed which is 80 feet per minute. The defined thickness is the thickness of the fibrous batt 12.

| Freq. | 1 mil EVA* up 15% speed, 18 mm thick 372° F. sample 11 | 1 mil EVA* up 10% speed, 8 mm thick 370° F. sample 12 | 1 mil EVA* down 10% speed, 8 mm thick 370° F. sample 12 | 1 mil EVA* up 15% speed, 8 mm thick 372° F. sample 13 | 1 mil EVA* down, 15% speed, 8 mm thick 372° F. sample 13 | Dow 933 down, 15% speed, 8 mm thick 370° F. sample 14 | Dow 933 up 15% speed, 8 mm thick 370° F. sample 14 | Virgin VTP02825 sample 15 (no film) | Virgin VTP03208 sample 16 (no film) |
|---|---|---|---|---|---|---|---|---|---|
| 200 | 0.12 | 0.11 | 0.13 | 0.12 | 0.11 | 0.12 | 0.13 | 0.19 | 0.08 |
| 250 | 0.25 | 0.15 | 0.12 | 0.15 | 0.12 | 0.13 | 0.15 | 0.22 | 0.14 |
| 315 | 0.26 | 0.20 | 0.13 | 0.18 | 0.16 | 0.I5 | 0.15 | 0.26 | 0.17 |
| 400 | 0.27 | 0.22 | 0.15 | 0.21 | 0.18 | 0.16 | 0.16 | 0.28 | 0.18 |
| 500 | 0.32 | 0.33 | 0.21 | 0.31 | 0.21 | 0.22 | 0.23 | 0.31 | 0.23 |
| 630 | 0.40 | 0.47 | 0.26 | 0.38 | 0.25 | 0.26 | 0.29 | 0.36 | 0.27 |
| 800 | 0.51 | 0.38 | 0.29 | 0.36 | 0.29 | 0.27 | 0.32 | 0.36 | 0.29 |
| 1000 | 0.67 | 0.42 | 0.34 | 0.43 | 0.36 | 0.34 | 0.40 | 0.44 | 0.37 |
| 1250 | 0.82 | 0.59 | 0.40 | 0.57 | 0.40 | 0.39 | 0.47 | 0.49 | 0.41 |
| 1600 | 0.96 | 0.82 | 0.46 | 0.76 | 0.46 | 0.45 | 0.58 | 0.53 | 0.45 |
| 2000 | 1.01 | 0.95 | 0.52 | 0.89 | 0.51 | 0.49 | 0.69 | 0.53 | 0.49 |
| 2500 | 1.06 | 0.99 | 0.58 | 1.00 | 0.55 | 0.54 | 0.77 | 0.52 | 0.51 |
| 3150 | 1.00 | 1.00 | 0.62 | 1.10 | 0.59 | 0.57 | 0.89 | 0.52 | 0.52 |
| 4000 | 0.87 | 0.85 | 0.66 | 1.00 | 0.66 | 0.61 | 0.93 | 0.51 | 0.56 |
| 5000 | 0.74 | 0.76 | 0.68 | 0.97 | 0.68 | 0.63 | 0.99 | 0.49 | 0.55 |
| 6300 | 0.67 | 0.65 | 0.75 | 0.91 | 0.73 | 0.72 | 1.02 | 0.49 | 0.57 |
| 8000 | 0.56 | 0.52 | 0.76 | 0.70 | 0.74 | 0.75 | 0.97 | 0.46 | 0.58 |
| 10000 | 0.58 | 0.45 | 0.75 | 0.60 | 0.75 | 0.82 | 0.88 | 0.43 | 0.54 |

*1 mil EVA Blend Coax Laminate Film

| | AirFlow Resistance | KPA- Sec/m$^3$ |
|---|---|---|
| Sample No. 14 | Dow 15% speed | 500 |
| Sample No. 12 | mil EVA Blend Coax Laminate Film 10% speed | 2,900 |
| Sample No. 13 | 1 mil EVA Blend Coax Laminate Film 15% speed | 1,900 |
| | Cells per m$^2$ | |
| Sample No. 14 | Dow 15% speed | 800,000 |
| Sample No. 12 | 1 mil EVA Blend Coax Laminate Film 10% speed | 100,000 |
| Sample No.13 | 1 mil EVA Blend Coax Laminate Film 15% speed | 170,000 |

It is to be understood that the invention is not limited to the exact construction illustrated and described above, but that various changes and modifications may be made without departing from the spirit and scope of the inventions as defined in the following claims.

We claim:

1. A method of tuning the sound attenuation characteristics of a sound absorbing pad during its fabrication, the method comprising the steps of:

applying a film to a fibrous batt having a plurality of fibers to form the sound absorbing pad;

applying heat to the film;

varying the heat applied to the film to control the surface porosity of the film; and wherein the porosity provides sound attenuation characteristics which may be tuned to attenuate different sound frequencies.

2. The method of claim 1 further comprising the steps of:

applying pressure to the film; and varying the pressure applied to the film to control the porosity of the film.

3. The method of claim 1 further comprising the step of varying the time of exposure to the heat and pressure.

4. The method of claim 1, wherein the heat softens the film to permit the fibers to penetrate into the film.

5. The method of claim 1, wherein the fibers create microruptures in the film.

6. The method of claim 1, wherein the fibers create perforations in the film.

7. The method of claim 1, wherein the sound absorbing pad can be tuned to match a particular absorption coefficient versus frequency curve.

8. A sound absorbing pad having a film with a random distribution of perforations formed by a process comprising:

applying a film to a fibrous batt having a plurality of fibers to form the tunable sound absorbing pad;

applying heat to the film;

varying the heat applied to the film to control the number of perforations of the plurality of fibers through the film; and wherein the perforations control the sound attenuation characteristics of the sound absorbing pad, whereby the sound absorbing pad may be tuned to attenuate different sound frequencies.

9. The sound absorbing pad of claim 8, wherein the tunable sound absorbing pad will attenuate sound from 20 Hz to 20 kHz.

10. The sound absorbing pad of claim 8, wherein the perforations provide a porosity of the film.

11. The sound absorbing pad of claim 10, wherein the porosity is provided by microruptures.

12. The sound absorbing pad of claim 10, wherein the porosity is provided by holes.

13. The sound absorbing pad of claim 10, wherein the porosity is provided by fiber penetrations.

14. The sound absorbing pad of claim 13, wherein the penetrations form microruptures in the film.

15. The sound absorbing pad of claim 13, wherein the penetrations form the perforations in the film.

16. The sound absorbing pad of claim 8, wherein the number of perforations can be varied to change the air flow resistance of the sound absorbing pad to tune the sound absorbing pad to absorb sound in specific frequencies.

17. The sound absorbing pad of claim 16 wherein the number of perforations is varied by the application of heat to the film.

18. The sound absorbing pad of claim 8 further comprising applying pressure to the film and the fibrous batt to vary the number of perforations.

19. The sound absorbing pad of claim 8, wherein the fibrous batt includes polyethylene terepthalate fibers.

20. The sound absorbing pad of claim 8, wherein the fibrous batt includes natural fibers.

21. The sound absorbing pad of claim 8, wherein the film includes polyester.

22. The sound absorbing pad of claim 8, wherein the film is thermoformable.

23. The sound absorbing pad of claim 8, further comprising applying a second film to a second side of the fibrous batt.

24. The sound absorbing pad of claim 8, wherein the fibers and the film are comprised of the same polymer, whereby the sound absorbing pad is recyclable.

25. The sound absorbing pad of claim 8, wherein the sound absorbing pad can be tuned to match a particular absorption coefficient versus frequency curve.

26. A method of tuning the sound attenuation characteristics of a sound absorbing pad during its fabrication, the method comprising the steps of:

applying a film to a fibrous batt having a plurality of fibers to form the sound absorbing pad;

applying heat to the film;

varying the heat applied to the film to control the porosity of the film; and wherein the porosity provides sound attenuation characteristics which may be tuned to attenuate different sound frequencies within a range from 20 Hz and 20 kHz.

27. The method of claim 26, wherein the porosity is provided by perforations.

28. The method of claim 26, wherein the fibrous batt includes polymeric fibers.

29. The method of claim 26, wherein the film includes polyester.

30. The method of claim 26, wherein the porosity is provided by fiber penetrations.

31. The method of claim 26, wherein the sound absorbing pad can be tuned to match a particular absorption coefficient versus frequency curve.

32. The method of claim 26, wherein the heat softens the film to permit the fibers to penetrate into the film.

* * * * *